US007090083B2

(12) United States Patent
Russell et al.

(10) Patent No.: US 7,090,083 B2
(45) Date of Patent: Aug. 15, 2006

(54) MODULE FOR SCREENING OR DIVERTING PARTICULATE MATERIAL AND METHOD OF PRODUCING THE MODULE

(75) Inventors: Lynn A. Russell, Scappose, OR (US); Terry R. Askew, South Wales (AU); Jack Coleman Gold, West Linn, OR (US)

(73) Assignee: Western Wire Works, Inc., Portland, OR (US)

( * ) Notice: Subject to any disclaimer, the term of this patent is extended or adjusted under 35 U.S.C. 154(b) by 0 days.

(21) Appl. No.: 10/678,421

(22) Filed: Oct. 2, 2003

(65) Prior Publication Data

US 2004/0074821 A1 Apr. 22, 2004

Related U.S. Application Data

(60) Division of application No. 09/904,197, filed on Jul. 11, 2001, now Pat. No. 6,886,697, which is a continuation of application No. 09/503,961, filed on Feb. 14, 2000, now Pat. No. 6,267,246.

(51) Int. Cl.
*B07B 1/49* (2006.01)

(52) U.S. Cl. ..... 209/405; 209/399; 209/408; 209/409

(58) Field of Classification Search ..... 209/405, 209/311, 404
See application file for complete search history.

(56) References Cited

U.S. PATENT DOCUMENTS 3,980,555 A 9/1976 Freissle
4,141,821 A * 2/1979 Wolff ..... 209/405
4,219,412 A 8/1980 Hassall
4,409,099 A 10/1983 Wolff
4,661,245 A 4/1987 Rutherford et al.
4,670,136 A 6/1987 Schmidt et al.
4,674,251 A 6/1987 Wolff
4,757,664 A 7/1988 Freissle
4,871,288 A 10/1989 Schmidt et al.
4,882,044 A 11/1989 Freissle
4,909,929 A * 3/1990 Tabor ..... 209/400
5,049,262 A 9/1991 Galton et al.
5,213,217 A 5/1993 Galton et al.
5,277,319 A * 1/1994 Henry, Jr. ..... 209/399
5,361,911 A 11/1994 Waites, Sr. et al.

(Continued)

FOREIGN PATENT DOCUMENTS

DE 36 06 854 A1 9/1987

(Continued)

*Primary Examiner*—Kathy Matecki
*Assistant Examiner*—Jonathan R. Miller
(74) *Attorney, Agent, or Firm*—Marger Johnson & McCollom PC

(57) ABSTRACT

A module is provided for screening or diverting particulate material. A method for producing a module for screening or diverting particulate material is also provided. Each module comprises either a screening member having an array of sieve apertures of a predetermined size defined therein for allowing particulate material up to the predetermined size to pass through the module or a diverting member or redirecting the flow path of the particulate material. A plurality of posts removably and interlockingly supports at least one reinforcing support frame and at least one module. Each reinforcing support frame is interlockably mounted onto the posts, and is readily detachable therefrom. Each module is disposed on the interlocking posts and is mounted onto, and readily detachable from, the reinforcing support frame. Each module is further positioned on the frame such that any particulate material passing through the module passes through the frame.

36 Claims, 14 Drawing Sheets

U.S. PATENT DOCUMENTS

| | | | | | |
|---|---|---|---|---|---|
| 5,372,261 | A | | 12/1994 | Galton et al. | |
| 5,377,846 | A | | 1/1995 | Askew | |
| 5,462,175 | A | | 10/1995 | Bokor | |
| 5,464,101 | A | * | 11/1995 | Freissle | 209/405 |
| 5,664,685 | A | | 9/1997 | Freissle | |
| 5,755,334 | A | | 5/1998 | Wojcik et al. | |
| 5,769,241 | A | * | 6/1998 | Woodgate | 209/399 |
| 5,829,599 | A | * | 11/1998 | Woodgate | 209/399 |
| 5,938,042 | A | | 8/1999 | Freissle et al. | |
| 6,206,200 | B1 | * | 3/2001 | Gilles et al. | 209/399 |
| 6,253,926 | B1 | * | 7/2001 | Woodgate | 209/399 |
| 6,260,711 | B1 | * | 7/2001 | Woodgate | 209/405 |

FOREIGN PATENT DOCUMENTS

| | | |
|---|---|---|
| DE | 41 36 898 A1 | 5/1993 |
| EP | 0 167 999 B2 | 1/1986 |
| WO | WO 90/05594 | 5/1990 |
| ZA | 74/5092 | 8/1975 |

* cited by examiner

MODULE FOR SCREENING OR DIVERTING PARTICULATE MATERIAL AND METHOD OF PRODUCING THE MODULE

RELATED APPLICATION

This is a divisional of U.S. Ser. No. 09/904,197, filed on Jul. 11, 2001, now U.S. Pat No. 6,886,697, which is a continuation application of U.S. Ser. No. 09/503,961, filed on Feb. 14, 2000, now U.S. Pat. No. 6,267,246.

BACKGROUND OF THE INVENTION

This invention relates to modules for screening particulate material by size, or for diverting the particulate material, to methods of producing such particulate material screening systems, and to reinforcing support frames for such screening modules.

Various modes for connecting a screening module to an underlying frame to form a screening deck are known in the prior art. Some methods require spacers or adapter bars between the screening module and the deck support structure. An example of such an arrangement is shown in U.S. Pat. No. 4,409,099 ("the '099 patent"). The '099 patent shows screening modules supported only at their corners on spacer modules so that the screening element is spaced above the support structure, ostensibly to increase the effective screening area. The intermediate spacer elements, however, add considerably to the cost and complexity of the screening apparatus and increase its overall height. In addition, in order to reduce abrasion by the sifted particulate material to the support structure members, the support members must be specially formed. That requirement represents another expensive departure from standard practices in the industry.

Another screening apparatus that employs specialized components to intermediate the screening elements and the support structure is shown in U.S. Pat. No. 4,219,412 ("the '412 patent"). There, a molded plastic support frame is adapted to receive individual screening elements. The plastic frame, in turn, is connected to the deck support bars. This combination leads to several disadvantages similar to the device of the '099 patent mentioned above. The '412 patent does not disclose whether or how individual screening modules might be removed and replaced.

Similarly, U.S. Pat. No. 4,661,245 ("the '245 patent") shows a screening system that incorporates clamping bars which receive the individual screening elements. The clamping bars, in turn, are bolted onto the support bars. The resulting structure is unduly complex, expensive, and increases the height of the deck, among other shortcomings.

Several other methods are known for connecting flat screening elements directly to a supporting frame, thereby avoiding the use of spacers or adapter bars. One such method uses a depending hook or skirt member integrally formed in the outlet side of the screening element. An example is shown in U.S. Pat. No. 3,980,555 ("the '555 patent"). In the '555 patent, depending hooks of abutting screening elements are inserted into a frame member through a common mounting hole. The hooks extend out of the mounting hole in the underside of the frame and engage the frame member to hold the screening elements in place. The resulting screening deck has a substantially contiguous inlet surface that provides no access to the mounting hooks for disconnecting an element which requires replacement. Accordingly, such arrangement requires a user to climb under a screening deck and cut the depending hooks off of a module to be replaced. Or, more commonly, a user will pry the element off from the top (inlet side) and destroy it in the process. Either way, the module is rendered useless; a result that is acceptable for modules which are worn out, but wasteful if the module is being replaced merely to change sieve size.

Another attachment method is shown in the '412 patent, discussed above. Individual screening elements are connected to an intermediate supporting frame by integrally formed depending hook-shaped members, similar to those disclosed in the '555 patent. The depending hook members are inaccessible even from the outlet side of the screen, however, as they are enclosed within elongate U-shaped channels. The '412 patent does not disclose any way of removing an individual screening element for replacement, short of disassembling the screening deck.

Another method of connecting screening elements to an underlying frame is to employ securing pins as suggested, for example, in U.S. Pat. No. 4,141,821 ("the '821 patent"). According to the '821 patent, abutting screening elements each include hollow tubular protrusions extending through a common mounting aperture formed in the frame so as to define a hollow tube. A securing pin is inserted into the tube from the inlet side of the deck to spread the protrusions apart beneath the aperture and thereby engage the frame. The securing pin is difficult to pry out of the tube from the inlet side of the screen, although the pin could, perhaps, be driven out from the outlet side of the screen. In any event, once removed, the pin is loose and therefore subject to loss. This is a decided risk in the context of screening machines, as it often is impractical or impossible to retrieve an errant securing pin. A similar securing pin is employed in the apparatus disclosed in the '099 patent discussed previously.

An improved screening system developed by the common assignee of this patent application is provided in U.S. Pat. No. 5,049,262 ("the '262 patent"). The screening system disclosed in the '262 patent includes a rigid frame and a plurality of screening modules. A lock pin is provided which detachably connects the screening modules to the rigid frame. The lock pin is designed so that it remains connected to the frame while allowing removal of the screening modules from the frame, and positioning of a replacement screening module on the frame.

Yet another apparatus for removably mounting screening elements is disclosed in U.S. Pat. No. 4,670,136 ("the '136 patent"). The '136 patent discloses a two-piece elongate clamping element for clamping the edge of a plastic module or wire mesh screen. The apparatus includes a first, lower plastic profile fastened to the load-bearing substructure and arranged to engage under the edges of at least two mutually adjacent screen elements. A second, upper profile is detachably fastened over the first lower profile for retaining the screen elements clamped in place. Removal of a screening element requires removal of the upper plastic profile, thereby subjecting it to risk of loss like the securing pins of the '821 patent and the like. Additionally, the clamping structures of the '136 patent extend substantially beyond the edges of the frame, thereby reducing the effective screening area and subjecting the clamping structure itself to excessive wear from abrasion by particulate material being screened.

Another class of modular screen systems is represented by European Patent No. 167,999 ("EP '999") and DE 3606-854 ("DE '854"). More specifically, EP '999 is directed to a modular screen system which includes an assembly for attaching sieve elements to a metal support girder. The attachment assembly comprises upper and lower profile sections, and a protective ledge. The upper profile section engages the entire side portion of the sieve elements, while the lower profile section is connected within a continuous slot in the metal support girder. The upper profile can have a bolt-shaped cross-sectional configuration. The protective ledge covers the entire top surface of the support girder to prevent wear from abrasive material passing through the sieve elements. Since the upper profile section is in locking engagement with the entire extent of the side of the sieve element, it is extremely difficult and time consuming for users to remove and replace individual damaged screen modules. Furthermore, this removal process often results in unwanted destruction of adjacent undamaged screen modules.

U.S. Pat. No. 4,674,251 ("the '251 patent") is directed to a screen component for use in modular screening decks. The screen comprises a frame-shaped molding which surrounds one or more fields having screening openings. At least two of the opposite sides of the molding have supporting members with fastening elements between which reinforcement rods are embedded in the molding extends. Premolding inserts are also embedded in the supporting members and have insert openings on the sides of the inserts facing each other, into which the ends of the reinforcement rods are inserted.

U.S. Pat. No. 5,372,261 ("the '261 patent") and the '262 patent each relate to a system for screening particulate materials including replaceable screening modules mounted to a rigid frame by lock pins. An internal rigid frame member is typically provided within the module to stiffen it and prevent deformation thereof in the flow direction caused by the weight of particulate material. The lock pins are interlockingly engaged within attachment apertures of the modules.

U.S. Pat. No. 5,377,846 ("the '846 patent") relates to a screen system having screen panel modules supported side-by-side and/or end-to-end by a support structure assembly. The reinforced renditions of these modules are typically strengthened using a discrete reinforcing bar located therein.

U.S. Pat. No. 5,755,334 ("the '334 patent") describes an apparatus for mounting a panel on a rail member. Reinforced panels of the '334 patent also include discrete internal reinforcing members.

All of the patents cited above are incorporated in their entirety and by this reference made a part hereof.

In prior art systems when a screening module has become worn out and must be replaced, the old module must be disposed of and preferably recycled. Many reinforced screening modules of the prior art, however, have various types and configurations of discrete internal reinforcing members, which can cause a substantial recycling problem. For example, those screening modules having an internal reinforcing member are much more difficult and costly to dispose of than screening modules formed of two very different materials of constructions, for example, a polymeric module panel and a metal reinforcing member, which undergo different recycling processes. Therefore, the polymeric material portion of the reinforcing member must be separated from the metallic frame before recycling. Unfortunately, the metallic reinforcement is difficult to separate from the remaining polymeric portion of the screening module panel. This means that any recycling process for the above-described reinforced module will be time consuming and expensive.

Additionally, prior art screening polymeric modules having metallic reinforcement must be replaced in their entirety when the polymeric material becomes worn. There is no practical way to replace the polymeric material without also replacing the metallic reinforcing member, even though the reinforcing member can have a substantially longer useful life.

It is important that modules are readily secured during use to a deck assembly but can be easily removed therefrom when repair or replacement of a module is required. Both of these requirements are needed in order to provide maximum functionality of the system.

Accordingly, there remains a need for a particulate screening or diverting module which avoids the problems and meets the needs described above.

SUMMARY OF THE INVENTION

According to the needs of the industry, one object of the present invention is to provide a module for screening or diverting particulate material which allows for easy and quick attachment between to, for example, the underlying support members of a deck assembly.

Another object of the present invention is to provide such a module which facilitates ready attachment and removal from the deck assembly without causing damage or destruction to that module or adjacent screening modules.

To accomplish the objects of this invention, a module for screening, or diverting, particulate material is provided. The module is part of a system which includes at least one module, preferably a screening module, more preferably a non-reinforced module, and at least one reinforcing support frame, all of which are supported on a plurality of posts.

Each screening module comprises a screening member having an array of sieve apertures of a predetermined size. The sieve apertures allow passage of particulate material up to the predetermined size. Each screening module is positioned on a support frame so that particulate material passing through the screening module also passes through the frame. Each reinforcing support frame is readily and expeditiously, interlockably mounted onto, and detachable from, the posts. Each module is also interlockably mounted onto, yet readily detachable from, a structural support frame.

Each frame and the module can be formed of any suitable material. However, the frame is preferably formed of a polymeric or metallic material. The module is preferably non-reinforced so that the reinforcing support frame is substantially the sole means of reinforcement. More preferably, the module is formed of a polymeric material, which can be of a reinforcing or a non-reinforcing type.

The posts are mounted either directly or indirectly to the underlying support members of a deck assembly. Preferably, the posts are integrally joined to a mounting piece, which in turn is attached to underlying support members of the deck assembly. Typically, this type of attachment is facilitated through feet on the middle and end posts. The posts can also be joined directly to the underlying support members, without the use of a mounting piece. Each post includes one or more slots and/or recesses for interlockingly engaging with one or more modules, and a frame slot within which one or more frames are readily and interlockingly mountable. The frame slot can be arcuate-shaped to receive and engage an arcuate-shaped corner of the frame. Each post can be designed to interlocking support a plurality of screens and a plurality of support frames so that, for example, at least a portion of the particulate materials can be subject to more than one screening step.

Each module includes an engagement member which readily and interlockably mounts onto a support frame. Preferably, a portion of the engagement member has a gripping surface for engaging a complementary gripping surface located in the support frame. The gripping surfaces provide increased frictional engagement between the frame and the module. It also substantially prevents fines generated in the screening process from being entrapped between the screening module and it's supporting members. In this way, fines entrapment can substantially be avoided, so that excessive wear will be minimized, thereby failure of the locking connection between the module and the support frame assembly will be maintained for an extended period of time.

A method for producing a system for screening or diverting particulate material is also provided. The method includes providing a plurality of posts, at least one reinforcing support frame, and at least one module, preferably a non-reinforced module, more preferably a screening module, as described above. Each frame is interlockingly and detachably mounted onto the posts, and each module is interlockingly and detachably mounted onto the support frame. Each module is disposed over at least a portion of one of the posts, and positioned on the frame so that particulate material passing through the module also passes through the frame.

The novel posts of this invention provide for effective attachment to, and detachment from, both at least one module and at least one reinforcing support frame, and to the machine deck assembly. The locking engagement between each module and the posts provides for secure attachment, yet also allows easy removal without damage to the module itself or to other modules.

The invention also avoids the problem of lost securing pins, which occurs during the process of attachment and detachment of modules to the deck assembly in many prior art systems. Because the posts of the present invention are securely fastened to the deck assembly, either directly or through a mounting piece, rather than being held in place between adjacent connected modules, the lost securing pin problem can be avoided. Lost pins or the like can cause blockages resulting in substantial additional expense to the user.

The provision of separate and distinct screening modules and reinforcing support frames avoids other significant problems encountered in the prior art. Specifically, this invention allows a module to be readily attached to or removed from a support frame without removing the frame from the deck assembly. A new module can then be positioned over the existing support frame. This is particularly advantageous where the module has worn out, yet the support frame has a considerable amount of useful life remaining. Particulate penetration causes chaffing of many prior art clamping and support structures, which turn endangers the engagement therebetween.

Furthermore, the provision of modules which are separate from the support frame allows for simple, inexpensive recycling of worn or damaged parts. The module and support frame can be made of two different materials without hindering recycling efforts. Because the module and support frame are easily separated from each other, the module can undergo a recycling process adapted for that particular material, and the support frame can undergo a separate recycling process adapted for its particular material. This invention therefore allows for faster and cheaper recycling have worn or damaged components.

The unique construction of the system of the present invention typically forms screening modules having a reduced weight as compared to screening modules which include, for example, metallic reinforcement. The reduced weight screening modules of the present invention exhibit noise reduction during use and are more energy efficient. Furthermore, there are not corrosion problems and the deck weight reduction makes a significant savings in power employed by the end user.

The foregoing and other objects, features and advantages of the invention will become more readily apparent from the following detailed description of a preferred embodiment, which proceeds with reference to the drawings.

DETAILED DESCRIPTION OF A PREFERRED EMBODIMENT

Figure 1:
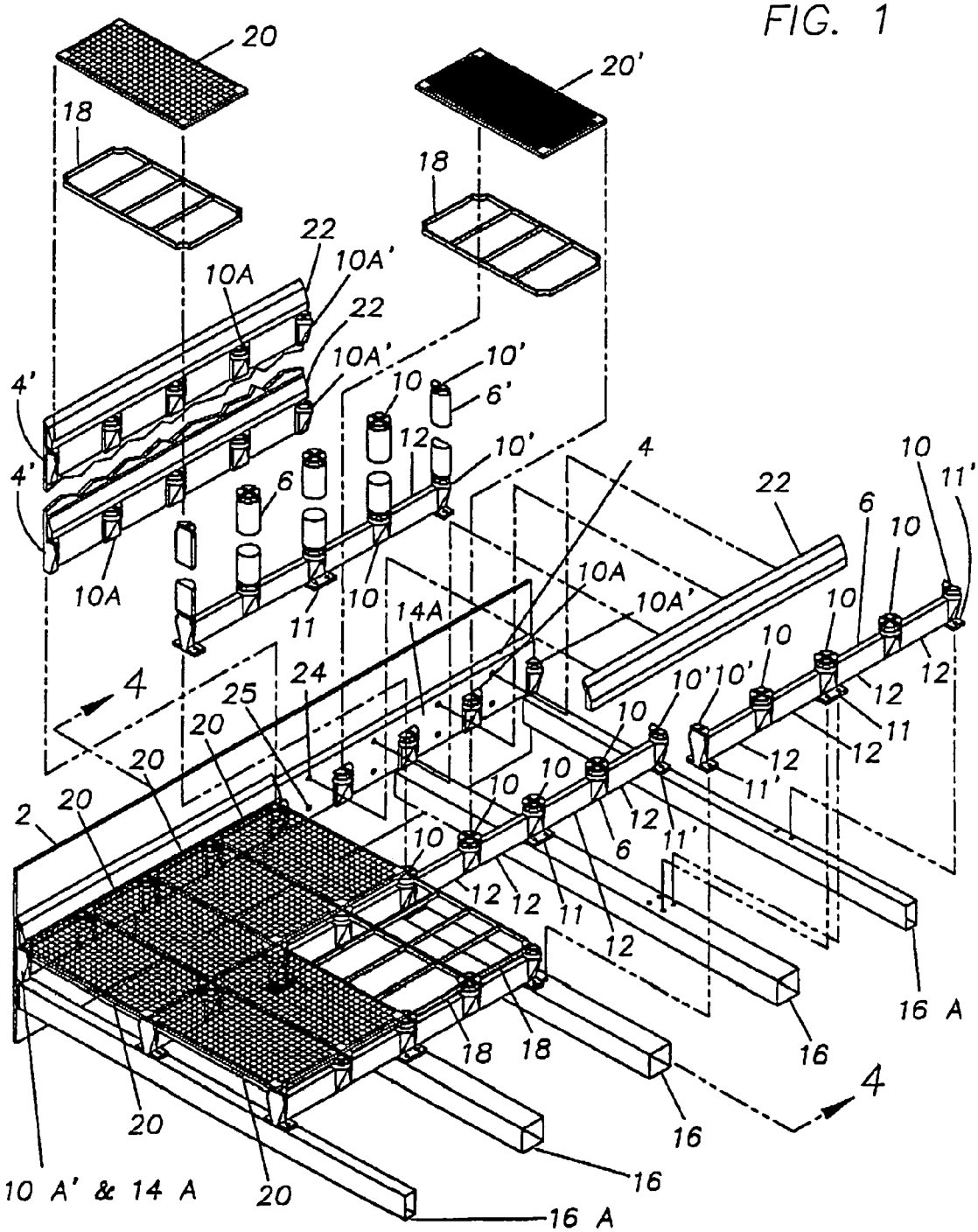
FIG. 1 is an exploded perspective view of a screening machine deck assembly having a particulate screening system according to preferred embodiments of the present invention.

Referring now to FIG. 1, an overall perspective view is depicted of a deck assembly, denoted "1", having a particulate flow screening system, having a top side 2, with easily replaceable screening modules according to a preferred embodiment of the present invention. A deck assembly is shown having a sidewall 50, underlying support members 16, and end support members 16A. The support members 16 and 16A support the weight of the particulate screening system and the particulate material being screened.

A preferred embodiment of the particulate screening system of this invention includes a wall mounting post assembly 4 (or 4' in the multi-screen version of an alternative embodiment) having one or more half posts 10A, one or more quarter posts 10A', and one or more wall mounting pieces 14A. Bolts secure each wall-mounting piece 14A to the sidewall 50 through boltholes 25. The shield 22 is connected to the wall-mounting piece 14A by being interlockingly snap fit into holes 24. Additional post assemblies 6 or 6' (multi-screen version) are secured to support members 16 and end support members 16A in the deck assembly. The posts at each end of the post assemblies 6 or 6' are half posts 10' for mating with half posts 10' at the ends of other post assemblies or with an end wall of the deck. The posts located along the mounting piece 12 between the half posts 10' are full posts 10. The center full post 10 and half posts 10' on the post assembly have post feet 11 and half feet 11', respectively, for mounting to either a support member 16 or an end support member 16A.

Reinforcing support frames 18 are placed over the post assemblies such that each frame 18 is secured between four posts. Each of the four posts may be either a full post 10, a half post 10A or 10', or a quarter post 10A'. Screening modules 20 are placed over the frames 18 and lockably, yet removably, secured thereto. The screening modules are also provided with post engagement members for interlockingly, yet detachably, securing the screening module to the posts. These post engagement members preferably include receptacles for receiving and engaging a portion of the posts and/or detents, which are inserted into and removably retained by a slot or recess in the post. In a preferred embodiment, a receptacle receives a portion of the post and an extension interlockingly engages a slot or recess in the post head. Each screening module 20 therefore lockably, yet removably, engages with each of the four posts to which its corresponding reinforcing support frame 18 is attached. The individual modules of the overall deck assembly will now be described in more detail.

Figure 2:
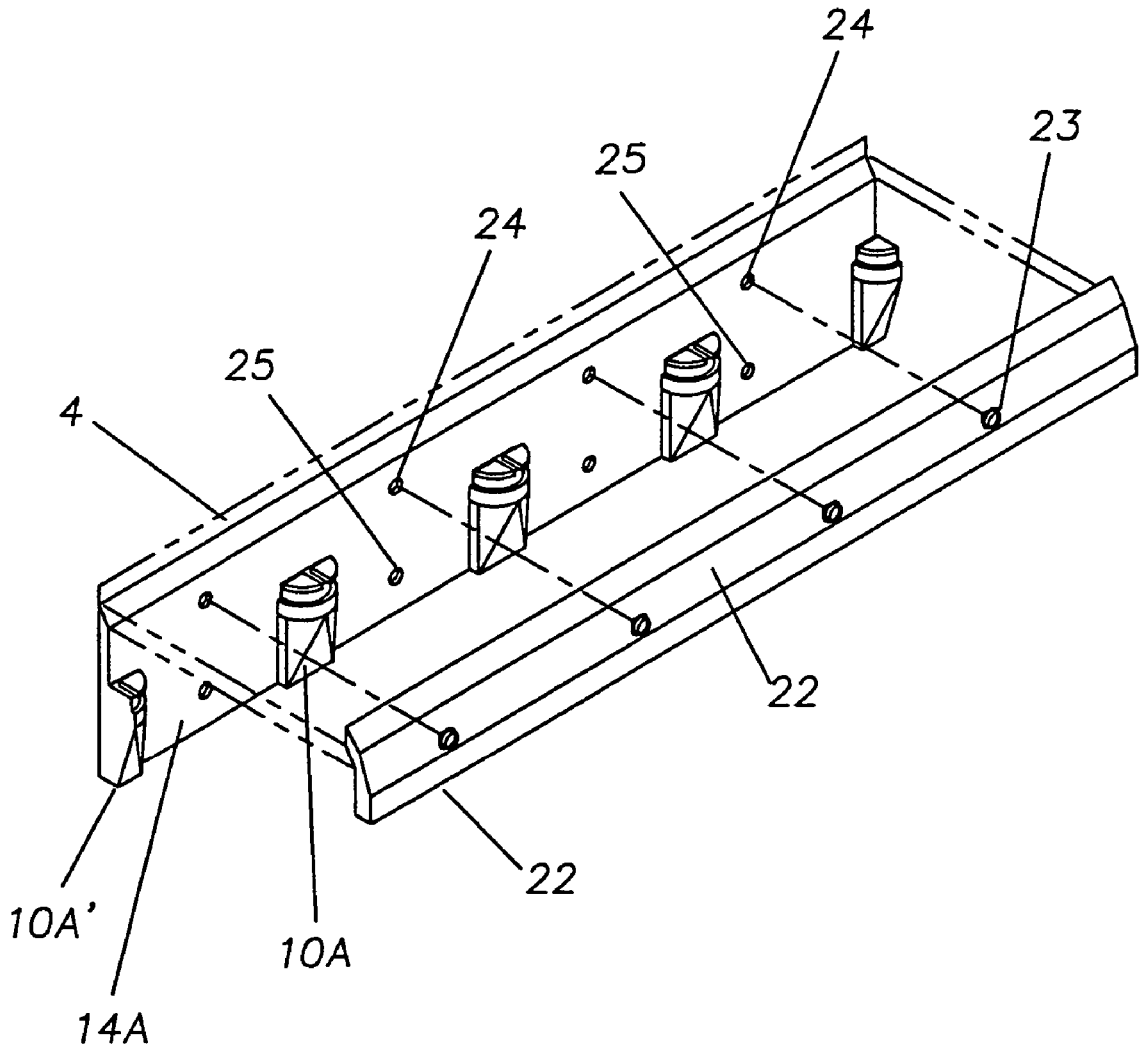
FIG. 2 is an exploded perspective view showing a preferred embodiment of a wall mounting post assembly of the particulate screening system shown in FIG. 1.

FIG. 2 shows a wall mounting post assembly 4 as used in the screening system of FIG. 1. Referring to FIG. 2, a preferred embodiment of a wall mounting post assembly 4 has a wall mounting piece 14A with half posts 10A and quarter posts 10A' integrally formed thereon or otherwise securely attached thereto. The wall-mounting piece 14A is substantially planar. The quarter posts 10A' are located on the ends of the wall mounting post assembly 4 to mate with quarter posts of adjacent wall mounting post assemblies or with an end wall of the deck. Bolts, inserted through boltholes 25, secure the wall-mounting piece 14A to the sidewall of the deck. In operation, the shield 22 directs the particulate matter being screened away from the deck wall and onto the screening modules, thereby preventing the particulate matter from becoming trapped on the wall mounting piece 14A or between the wall mounting piece 14A and the side wall.

Figure 3:
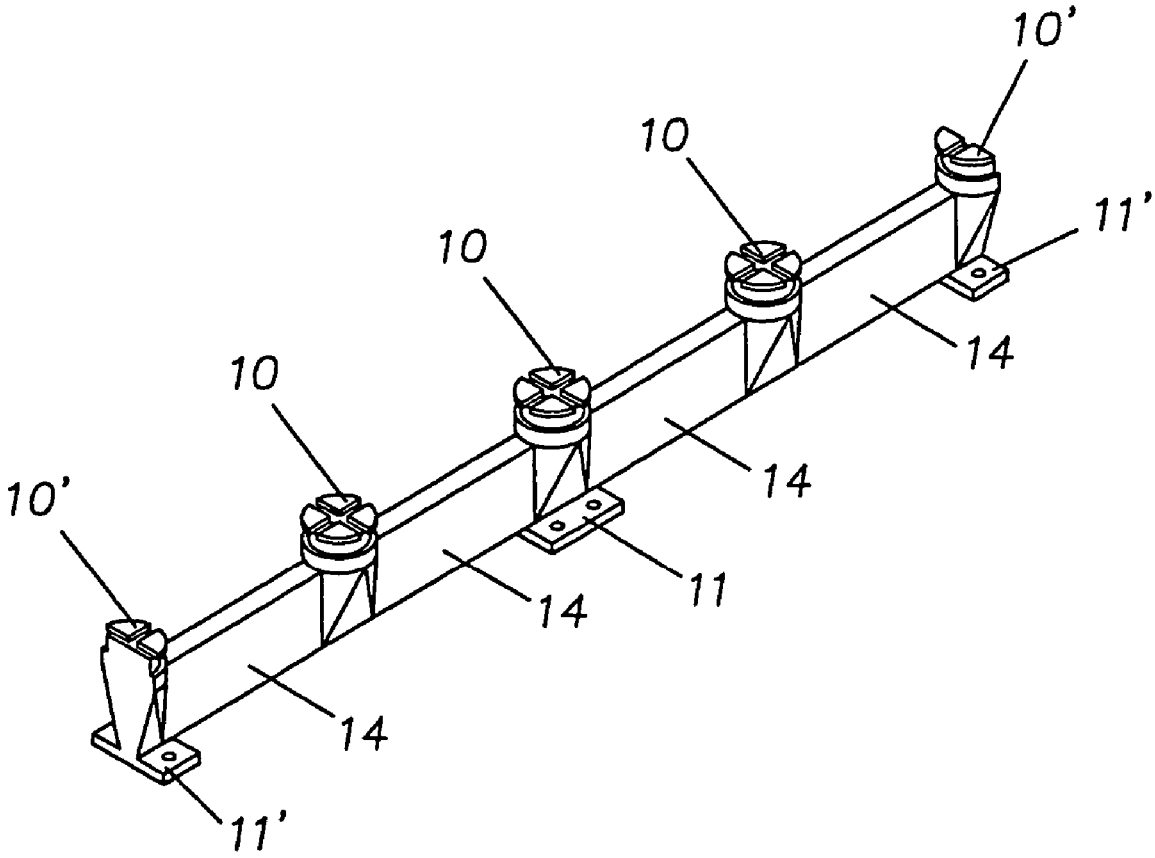
FIG. 3 is a perspective view of a preferred embodiment of a post assembly of the particulate screening system of FIG. 1.

FIG. 3 is a depiction of a post assembly 6 according to a preferred embodiment of the present invention. Referring to FIG. 3, a post assembly 6 (see FIG. 1) includes a mounting piece 14, full posts 10, and end half posts 10'. The mounting piece 14 may be a structural bar, rod, tube, or other sufficient supporting structure. In the preferred embodiment, the mounting piece 14 is a bar with which the posts 10 and 10' are integrally formed at equally spaced distances along its length. The posts 10 and 10' can, however, be securely attached to the mounting piece 14 by any appropriate chemical or mechanical fastening. The distance between the posts is determined based on the width of support frames and screening modules to be mounted therebetween. Each of the end half posts 10' is configured to mate with an end half post 10' of another post assembly or with an end wall of the deck. The full post 10 at the middle of the post assembly 6 is provided with two feet 11, which extend from opposite sides of the mounting piece 14. End half posts 10' are each provided with two half feet 11' extending from opposite sides of the mounting piece 14. The feet 11 and half feet 11' have holes so that the post assembly 6 can be mounted on support members of the deck.

Figure 4:
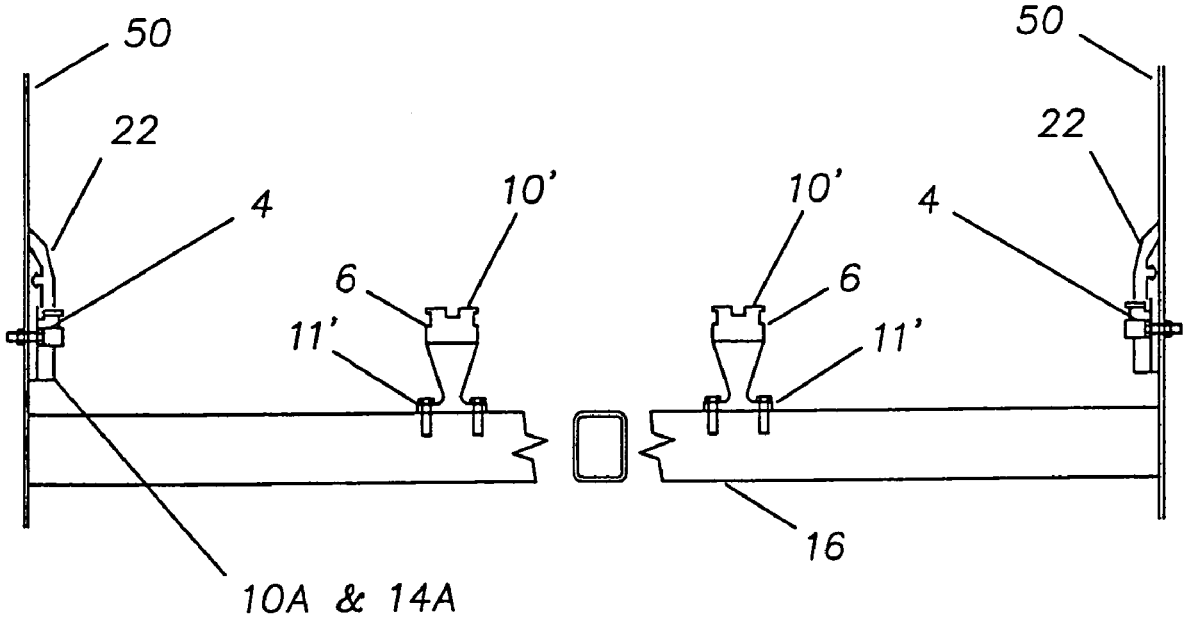
FIG. 4 is a cross-sectional view of the deck assembly of FIG. 1, taken along line 4—4 in FIG. 1.

FIG. 4 shows a cross-sectional view of the screening deck assembly of FIG. 1, taken along line 4—4 extending through the center of a support member 16. FIG. 4 shows the interconnections between wall mounting post assemblies 4 and the deck sidewalls 50 and between post assemblies 6 and the deck support members 16. Referring to FIG. 4, the wall mounting post assemblies 4 are bolted to side walls 50 of the deck assembly. Post assemblies 6 are bolted to support members 16 of the deck through apertures in their feet 11'. Shields 22 are joined to sidewalls 50 as previously described.

Figure 5:
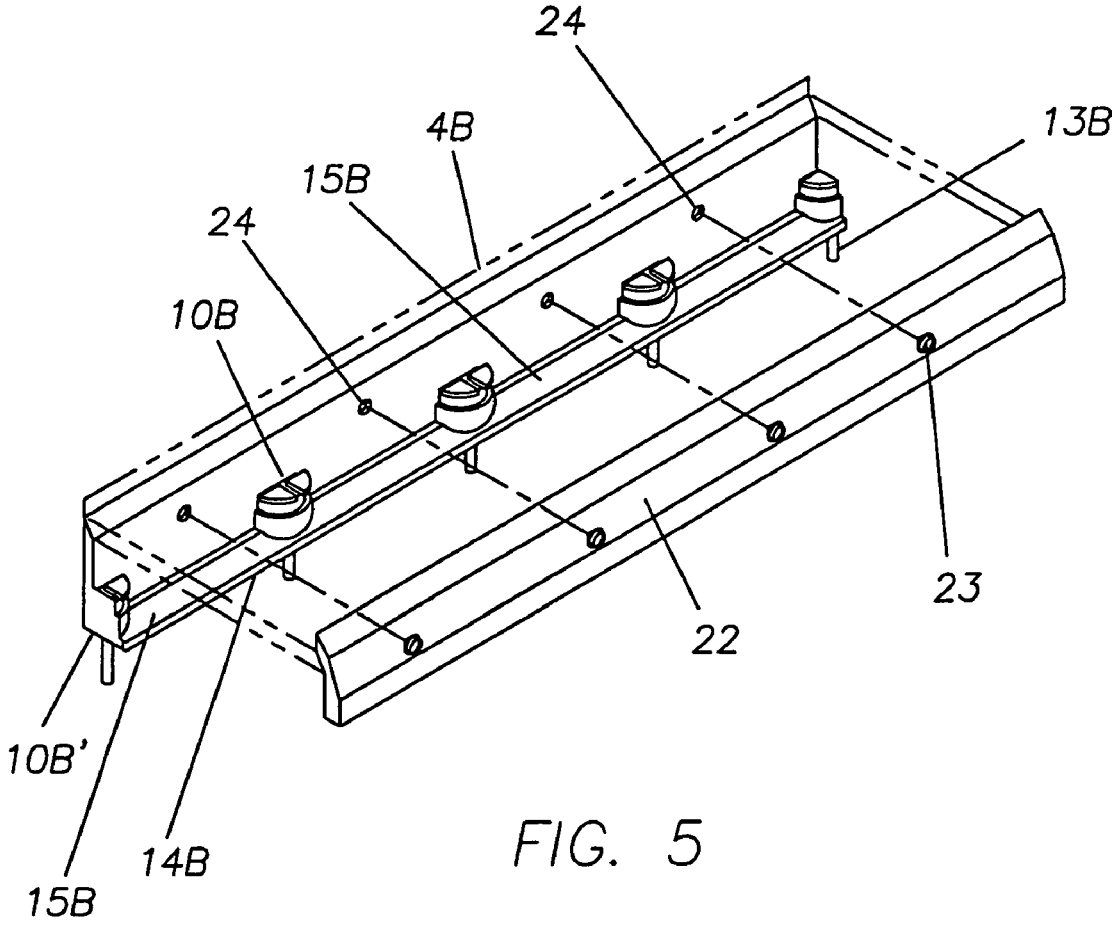
FIG. 5 shows an exploded perspective view of a wall mounting post assembly, similar to FIG. 2, according to another preferred embodiment of the present invention.

Referring to FIG. 5, an alternate embodiment of a wall mounting post assembly 4B is similar to the wall mounting post assembly 4 discussed with reference to FIG. 2. The primary difference between the two embodiments is that instead of being substantially planar, the wall-mounting piece 14B of this embodiment is L-shaped to provide a flow-diverting member along a base thereof. Also, mounting pins 13B extend from the bottom of the shelf-like member below each of the posts 10B and 10B'.

Figure 6:
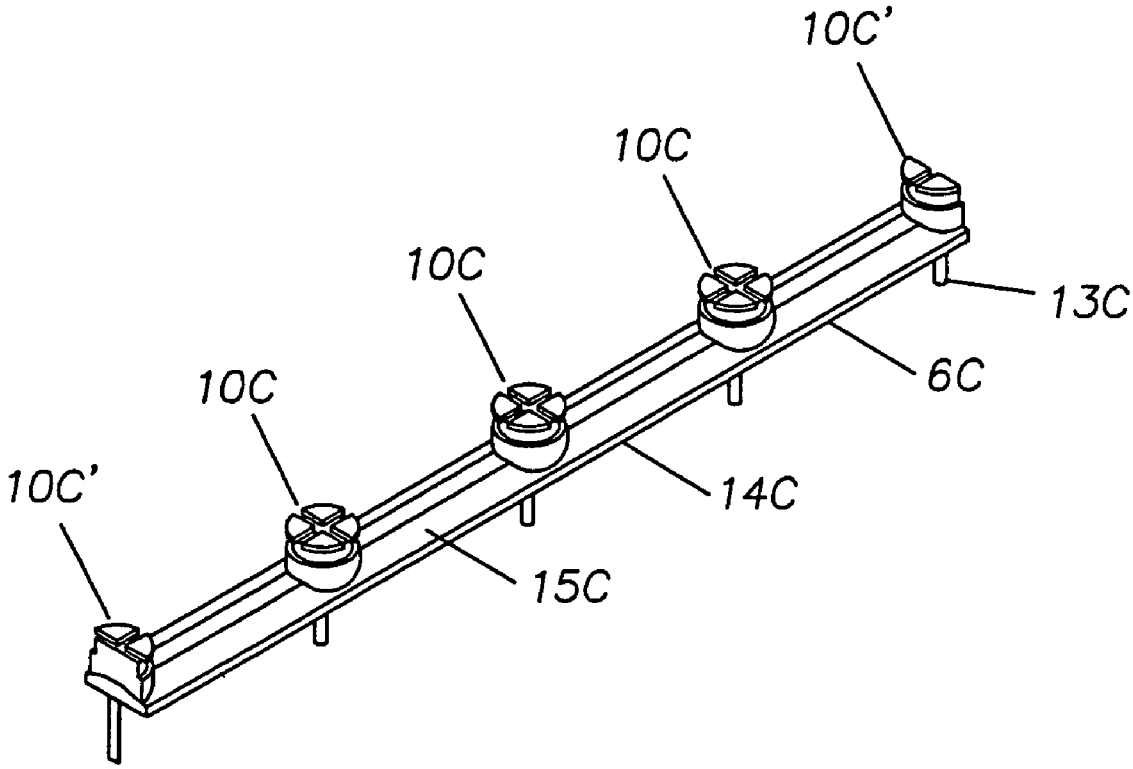
FIG. 6 shows a perspective view of a post assembly, similar to FIG. 3, according to another preferred embodiment of the present invention.

Now referring to FIG. 6, a post assembly 6C of another preferred embodiment is shown. The post assembly 6C of this embodiment is similar to that discussed with reference to FIG. 3, except that the mounting piece 14C of this embodiment is a substantially planar flow-directing member. Furthermore, rather than having feet 11 and 11' for attachment with the deck support members, mounting elements 13C are provided beneath each of the full posts 10C and half posts 10C'.

Figure 7:
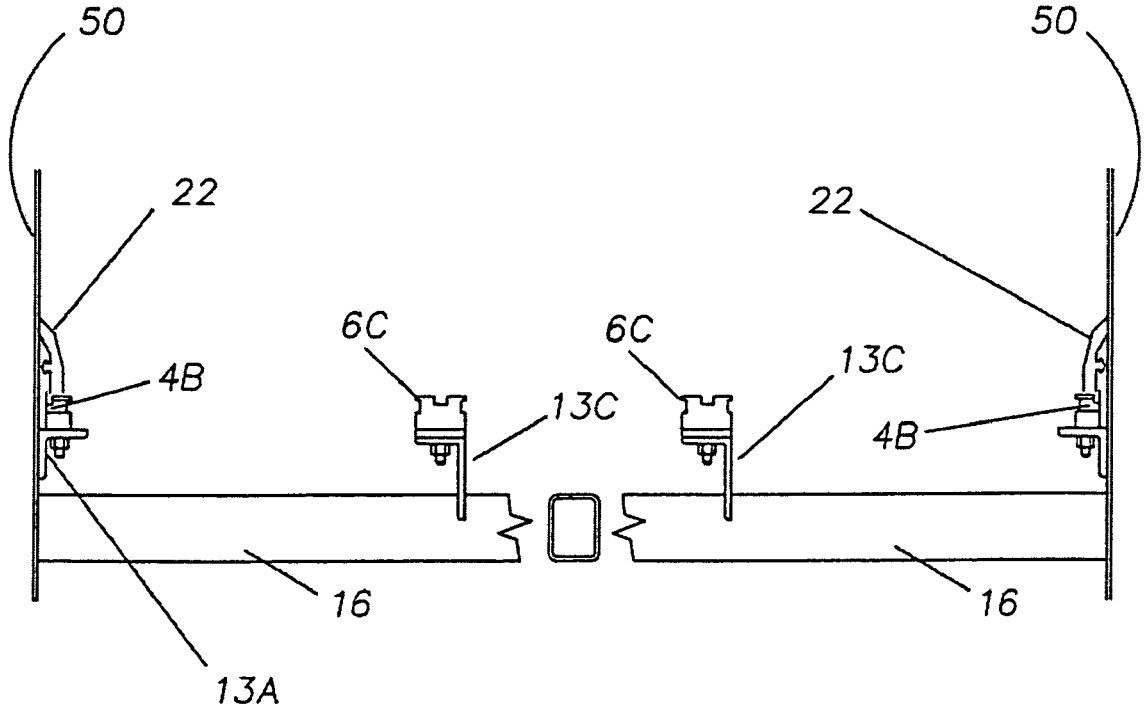
FIG. 7 is a cross-sectional view of a deck assembly, similar to FIG. 4, according to an alternate preferred embodiment of the present invention.

FIG. 7 shows a cross-sectional view of a screening deck assembly according to another preferred embodiment, similar to that described with respect to FIG. 4, but which has side mounting post assemblies 4B and post assemblies 6C as shown in FIGS. 5 and 6. As shown in FIG. 7, the wall mounting post assemblies 4B and the post assemblies 6C can be mounted on pins which secure to elements 13*a* and 13*b* of the deck or support members 16.

Figure 8:
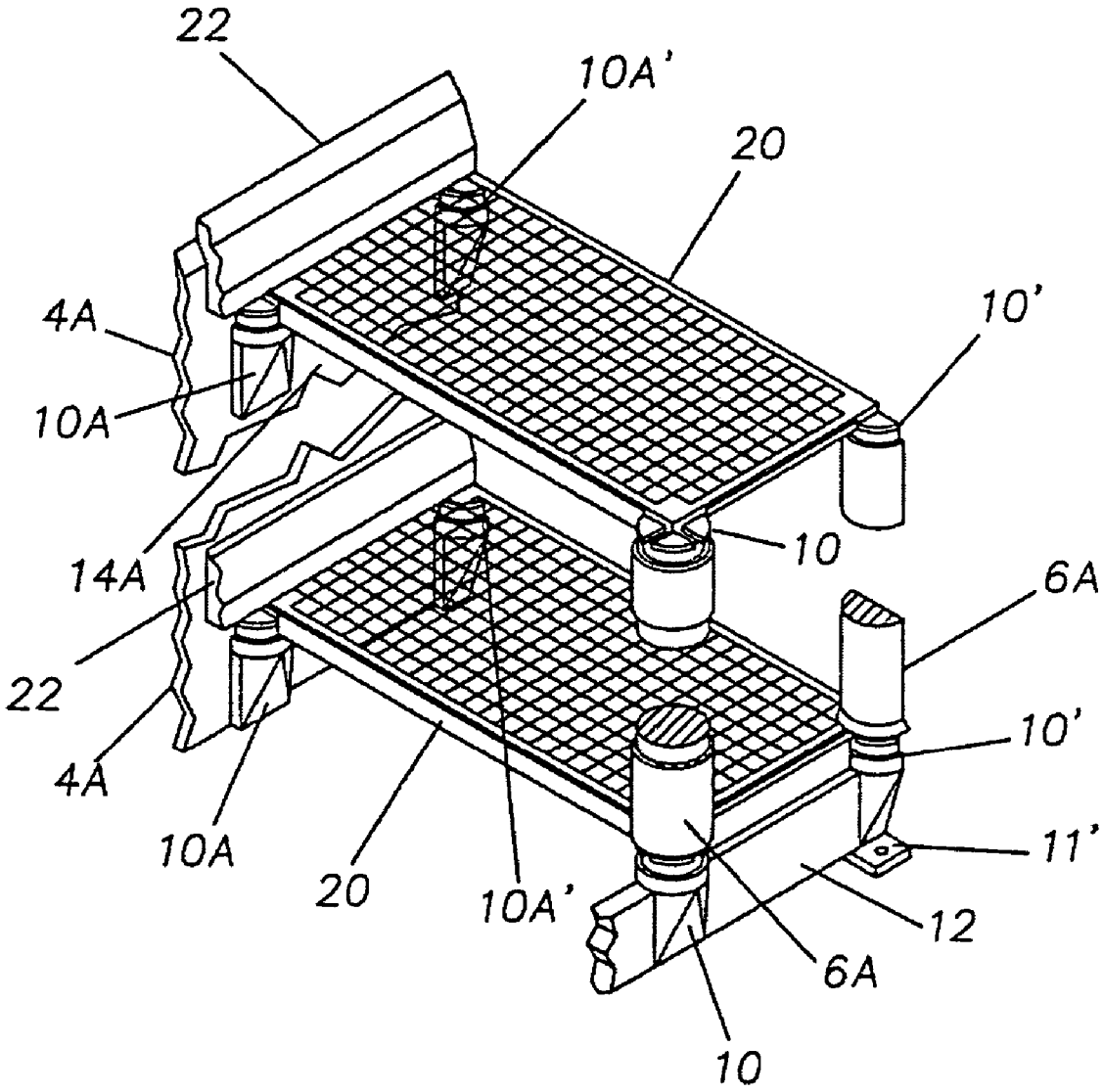
FIG. 8 is a perspective view of a multi-screen post assembly 6' and a multi-screen wall mounting assembly 4', similar to multi-screen post assembly 6A and multi-screen wall mounting assembly 4A of FIG. 1, according to a preferred embodiment of the present invention.

FIG. 8 is a perspective view of a multi-screen post assembly 6' and a multi-screen wall mounting assembly 4', similar to multi-screen post assembly 6' and multi-screen wall mounting assembly 4' of FIG. 1, according to a preferred embodiment of the present invention. More specifically, a plurality of screen 20 and support frames 18 (not shown) can be mounted onto a wall mounting post assembly 4', having one or more half posts 10A, one or more quarter posts 10A', and one or more wall mounting pieces 14A. A shield 22 is connected to the wall-mounting piece 14A as described above. Additional post assembly's 6' are secured to support members 16 and end support members 16A in the deck assembly. The posts at each end of the post assemblies 6' are half posts 10' for mating with half posts 10' at the ends of other post assemblies or with an end wall of the deck. The posts located along the mounting piece 12 between the half posts 10' are full posts 10. The center full post 10 and half posts 10' on the post assembly have post feet 11 and half feet 11', respectively, for mounting to either a support member 16 or an end support member 16A.

Figure 9A:
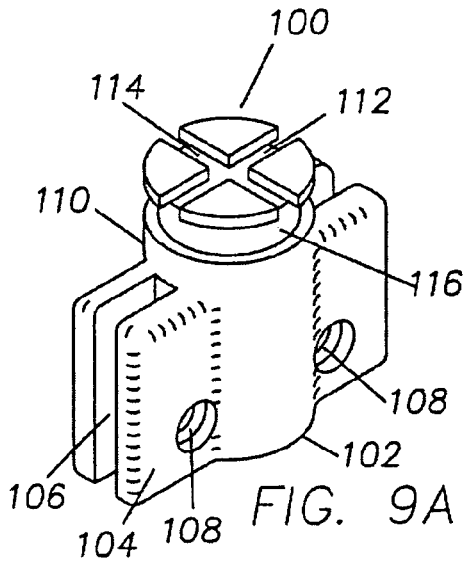
FIG. 9A is a perspective view of a full section post used in the particulate screening system shown in FIG. 1, according to a preferred embodiment of the present invention.

FIG. 9A provides perspective view of a full-sectional post used in the particulate screening system of FIG. 1, according to a preferred embodiment of the present invention. The post can either be integrally formed with, or mounted on, a mounting piece or wall mounting piece, or they can be independently attached to existing support structures in a deck assembly, without the use of mounting pieces. Referring to FIG. 9A, a full post 100 includes a body 102. The body includes means 104 for securing the post directly to a deck assembly or to a mounting piece. In a preferred embodiment, the posts are formed integrally with a mounting piece. As the embodiment shown in FIG. 9A, the means for securing includes a mounting piece slot 106 and apertures 108. The mounting piece slot 106 slides over a mounting piece. The body 102 is secured to the mounting piece by screws or bolts fastened through the apertures 108. Of course, it will be readily apparent that this invention can comprise any other means for securing known to those in the art. For instance, the posts can be chemically or mechanically adhered to the mounting piece in any way known in the art. The full post 100 includes a circular head 110 having two slots, a longitudinal slot 112 and a transverse slot 114, formed therein. The two slots 112 and 114 are formed as straight lines that extend from one end of the circular head 110 to the other, intersecting at right angles at the center thereof. The two slots 112 and 114 on the full post 100 are configured to removably and lockingly engage post engagement members located on mating corners of four screening modules. The full post 100 also includes an arcuate-shaped slot 116 located below the circular head 110. The arcuate-shaped slot 116 in the full post 100 is configured to removably and lockingly engage mating corners of four reinforcing support frames.

Figure 9B:
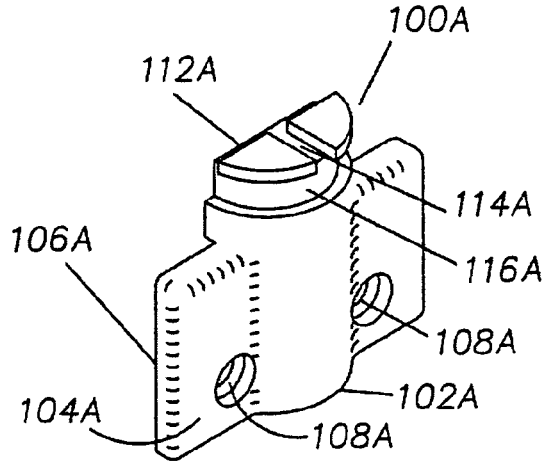
FIG. 9B is a perspective view of a half section post used in the particulate screening system shown in FIG. 1, according to a preferred embodiment of the present invention.

Referring to FIG. 9B, a sidewall half post 100A is shown. The side wall half post 100A is preferably integrally formed with a side wall mounting piece, but it can be otherwise mounted on the side wall mounting piece or attached directly to a side wall. The side wall half post 100A is nearly identical in construction to a full post 100 which has been bisected longitudinally along a centerline of the mounting piece slot 106. The sidewall half post includes a body 102A having means 104A for securing the post to a sidewall, a sidewall mounting piece, or other support structure. In this instance, the means 104A for securing includes a recess 106A and apertures 108A. The recess 106A slides onto the wall mounting piece and the body 102A is then secured to the wall mounting piece by bolts or screws fastened through the apertures 108A. The side wall half post 100A further includes a head 110A having a half-circular shape with an arc and a base. The half-circular head 110A has a longitudinal recess 112A and a transverse slot 114A formed therein. The recess 112A extends along the base of the half-circular head 110A. The slot 114A extends from a midpoint of the arc of the half-circular head to a centerpoint along the base. Both recess 112A and slot 114A are formed as straight lines, which extend from one side of the head 110A to the other and which intersect at substantially right angles at approximately a centerpoint of the base. The recess 112A and slot 114A of the side wall half post 100A are configured to removably secure post engagement members on mating corners of two screening modules. The sidewall half post 100A also includes an arcuate-shaped slot 116A located beneath the arc of half-circular head 10A. The arcuate-shaped slot 116A is configured to removably secure mating corners of two frames.

Figure 9C:
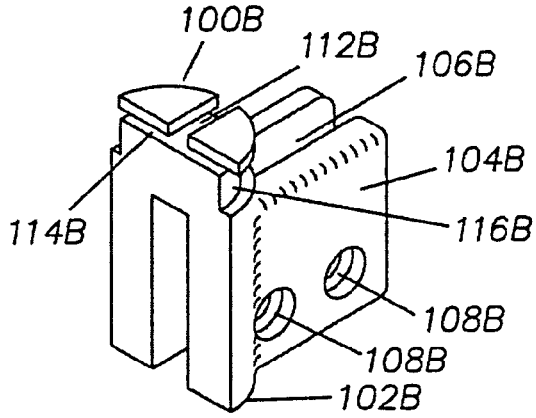
FIG. 9C is a perspective view of an alternate form of a half section post used in the particulate screening system shown in FIG. 1, according to a preferred embodiment of the present invention.

Referring to FIG. 9C, an alternate form of half post 100A, namely, half post 100B, for mating with a deck end wall or other half post 100B is shown. The half post 100B resembles a full post 100, which has been bisected transversely along a centerline of transverse slot 114B. The half post includes a body 102B having means 104B for securing the post to a mounting piece. The half post 100B is preferably integrally formed with a mounting piece, but may otherwise be attached to a mounting piece or a deck support member. In this instance, the means for securing includes a mounting piece slot 106B and apertures 108B. The mounting piece slot 106B slides onto the mounting piece; and the body 102B are secured to the mounting piece by bolts or screws fastened through the apertures 108B. The half post 100B further includes a head 110B having a half-circular shape with an arc and a base. The half-circular head 110B has a longitudinal slot 112B and a recess 114B formed therein. The longitudinal slot 112B extends from a midpoint of the half-circle's arc to a centerpoint along its base. The recess 114B extends along the base of the half-circular head 110B from one side of the head to the other in a direction transverse to the slot 112B. Both the slot 112B and the recess 114B are formed as straight lines, which intersect at right angles at the centerpoint along the base. The slot 112B and recess 114B are configured to removably secure post engagement members of mating corners of two screening modules. The half post 100B also includes an arcuate-shaped slot 116B located below the arc of the half-circular head 10B. The arcuate-shaped slot 116B is configured to removably secure mating corners of two frames.

Figure 9D:
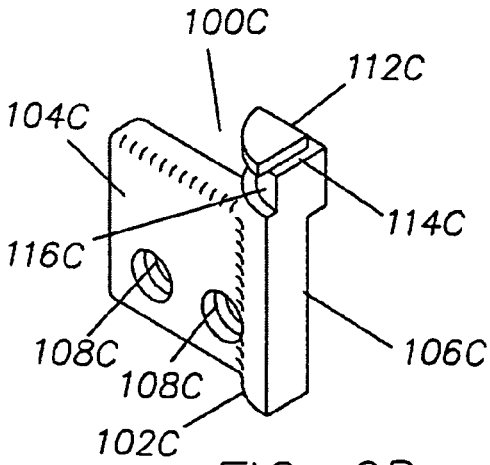
FIG. 9D is a perspective view of a quarter section post used in the particulate screening system shown in FIG. 1, according to a preferred embodiment of the present invention.

FIG. 9D shows one form of a quarter post 100C for mating with a sidewall of a deck and either an end wall of the deck or another quarter post. The quarter post 100C resembles a full post 100, which has been severed along both a centerline of the transverse slot 112 and a centerline of the longitudinal slot 114. The quarter post 100C includes a body 102C having means 104C for securing it to a sidewall or a sidewall-mounting piece. The quarter post 100C is preferably integrally formed with a wall mounting piece but can be otherwise secured to the wall mounting piece or directly to the sidewall. In this instance, the means for securing includes a mounting recess 106C and bolt apertures 108C. The mounting recess 106C slides onto the wall mounting piece, and the body 102C is then secured to the wall mounting piece by bolts fastened through the bolt apertures 108C. The quarter post 100C further includes a head 110C having a quarter-circular shape. The quarter-circular head 110C includes two recesses 112C and 114C, which extend along respective straight sides of the head 110C. The recesses 112C and 114C intersect at a right angle at the corner of the head 110C. The recesses 112C and 114C are configured to removably secure an engagement member on a corner of a screening module. The quarter post 100C also includes an arcuate-shaped slot 116C located below the arc of quarter-circular head 110C. The arcuate-shaped slot 116C is configured to removably secure a corner of a frame.

Figure 9E:
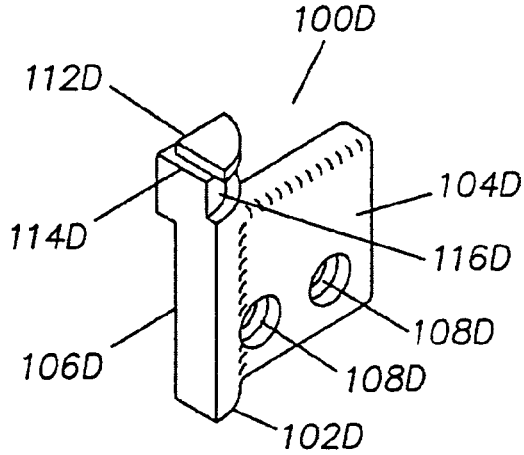
FIG. 9E is a perspective view of an alternative form of a quarter section post used in the particulate screening system shown in FIG. 1, according to a preferred embodiment of the present invention.

FIG. 9E shows another form of a quarter post 100D for mating with a sidewall of a deck and either an end wall of the deck or another quarter post. The quarter post 100D resembles a full post 100, which has been severed along both a centerline of the transverse slot 112 and a centerline of the longitudinal slot 114. The quarter post 100D includes a body 102D having means 104D for securing it to a sidewall or a sidewall-mounting piece. The quarter post 100D is preferably integrally formed with a wall mounting piece but can be otherwise secured to the wall mounting piece or directly to the sidewall. In this instance, the means for securing includes a mounting recess 106D and bolt apertures 108D. The mounting recess 106D slides onto the wall mounting piece, and the body 102D is then secured to the wall mounting piece by bolts fastened through the bolt apertures 108D. The quarter post 100D further includes a head 110D having a quarter-circular shape. The quarter-circular head 100D includes two recesses 112D and 114D, which extend along respective straight sides of the head 110D. The recesses 112D and 114D intersect at a right angle at the corner of the head 110D. The recesses 112D and 114D are configured to removably secure an engagement member on a corner of a screening module. The quarter post 100D also includes an arcuate-shaped slot 116D located below the arc of quarter-circular head 110D. The arcuate-shaped slot 116D is configured to removably secure a corner of a frame.

Figure 10:
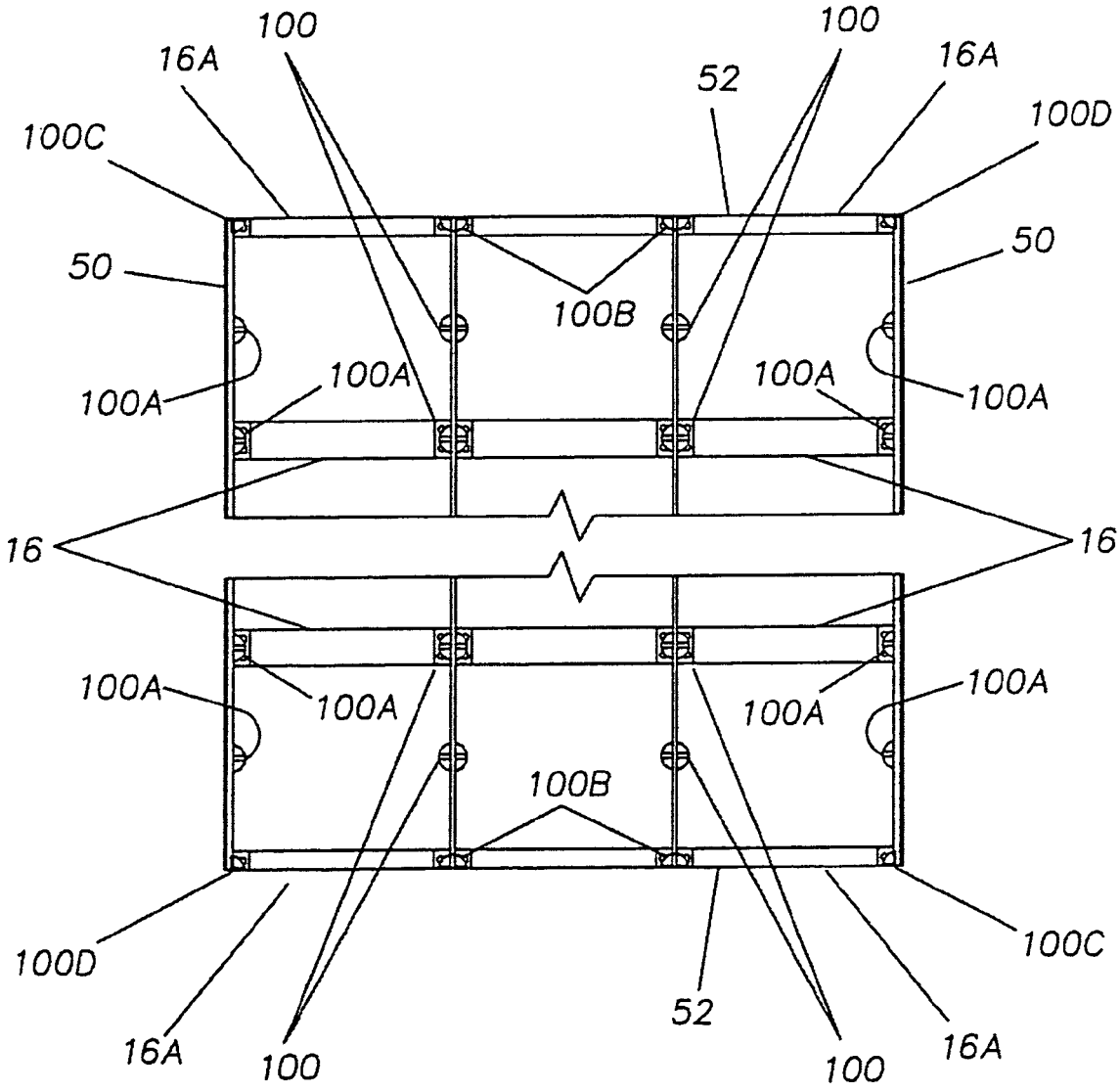
FIG. 10 is a plan view of the deck assembly of FIG. 1 showing locations of the posts shown in FIG. 6A.

FIG. 10 is a plan view of the deck assembly of FIG. 1, showing the locations of each of the various types of posts shown in FIGS. 9A–9E in accordance with a preferred embodiment of the present invention. Referring to FIGS. 9D and 9E, quarter posts 100C are located along the sidewalls 50 in the corners of the deck where the side walls 50 and end walls 52 meet. The quarter posts 100C can also be located along sidewalls 50 where two wall mounting pieces meet. Half posts 100B are located at the end walls 52 and also where two post assemblies meet. Sidewall half posts 100A are located along the sidewalls 50 between the quarter posts 100C. Finally, full posts 100 are located along mounting pieces between half posts 100B.

Figure 11A:
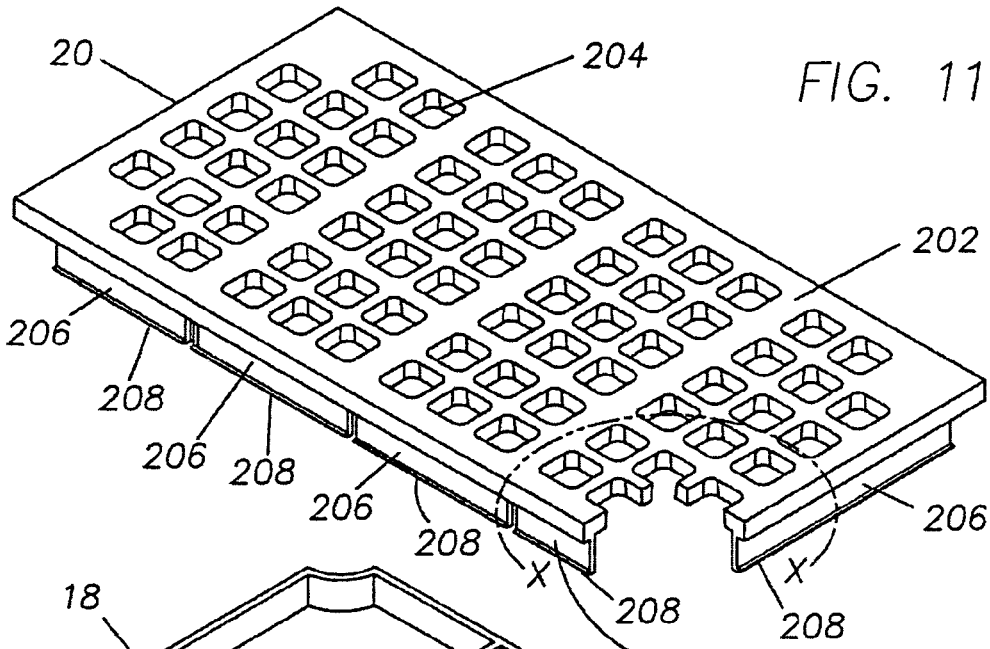
FIG. 11A is a perspective view of a screening module according to a preferred embodiment of the particulate screening system shown in FIG. 1.

Referring to FIG. 11A, a screening module 20 includes a substantially rectangular upper screening member 202 with an array of sieve apertures 204 defined therein. The sieve apertures 204 are sized to screen particulate matter being passed over the module, such that material smaller than the apertures is passed therethrough while larger material remains above the screening member 202. Frame engagement members 206 extend downwardly from a lower surface of the upper screening member 202. Each of the frame engagement members 206 is a detent member with a locking tab 208 on the end thereof.

Figure 11B:
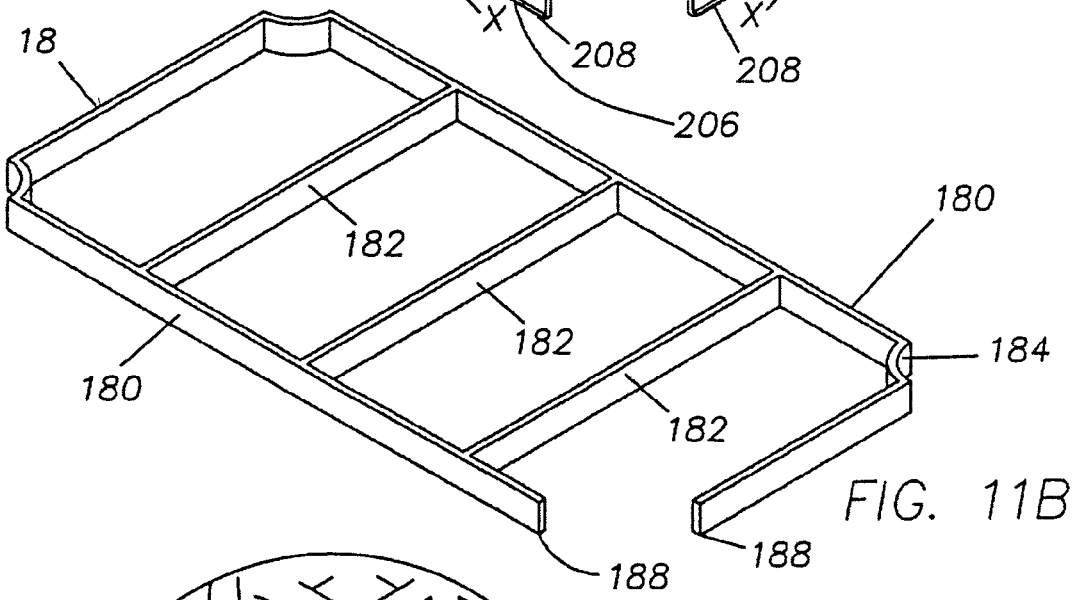
FIG. 11B is a perspective view of a support frame according to a preferred embodiment of the particulate screening system shown in FIG. 1.

Referring to FIG. 11B, a reinforcing support frame 18 has a perimeter member 180 formed in a substantially rectangular shape with bracing members 182 extending laterally between longitudinal sides thereof. The reinforcing support frame 18 also includes four arcuate-shaped corners 184 for removably engaging with arcuate-shaped slots of the posts described above. The frame 18 may be formed of a polymeric material, or it may be formed of a metal, carbon composite material, or any other material suitable for its intended purpose.

Figure 11C:
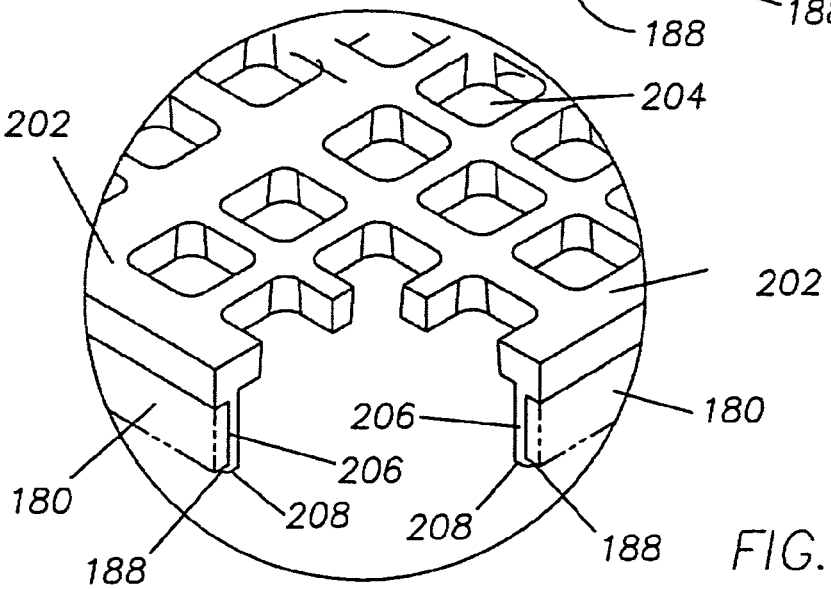
FIG. 11C is a sectional view taken along arcuate-shaped line X—X of FIG. 1A.

Now referring to FIG. 11C, the frame engagement members 206 of the screening module 20 lockingly, yet removably, engage with the perimeter member 180 and the bracing members 182 of the reinforcing support frame 18. Specifically, the screening module 20 is placed over the reinforcing support frame so that frame engagement members 206 extend along inwardly facing surfaces of the frame's perimeter member 180. Frame engagement members also extend along both sides of each of the bracing members 182. The locking tabs 208 on the end the frame engagement members 206 lockingly engage with engagement surfaces 188 on the bottom of the frame's perimeter member and bracing members.

Figure 12A:
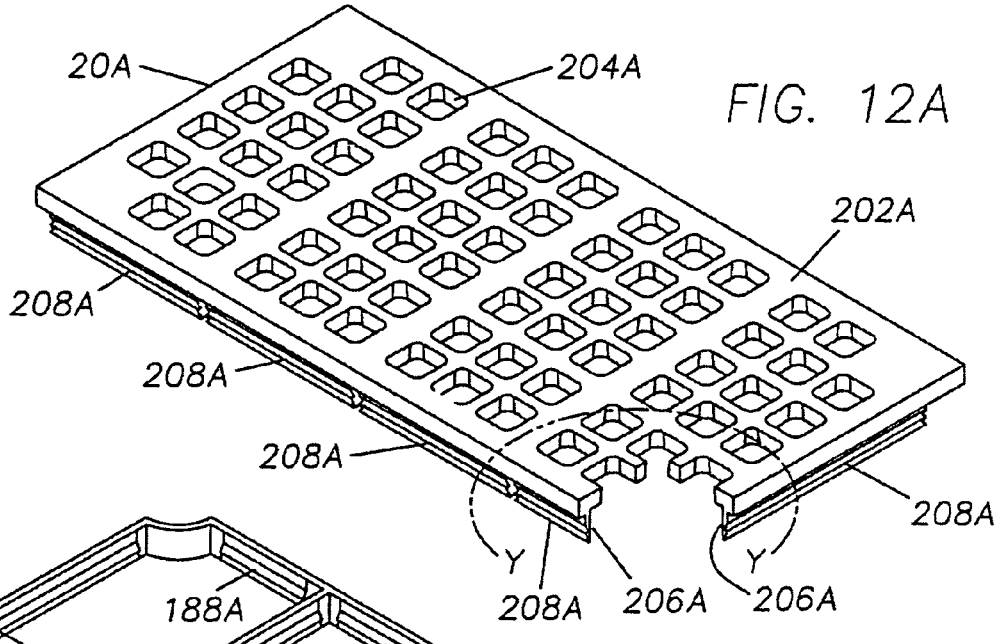
FIG. 12A is a perspective view of another screening module according to a preferred embodiment of the particulate screening system shown in FIG. 1.

Referring to FIG. 12A, a second preferred embodiment of a screening module 20A includes a substantially rectangular upper screening member 202A with an array of sieve apertures 204A defined therein. The sieve apertures in the array 204A are sized to screen particulate matter being passed over the module. Frame engagement members 206A extend downwardly from the bottom side of the upper screening member 202A. The frame engagement members 206A of this embodiment are substantially planar extensions having inwardly and outwardly facing sides. Each of the frame engagement members includes a gripping surface 208A located along its outwardly facing side.

Figure 12B:
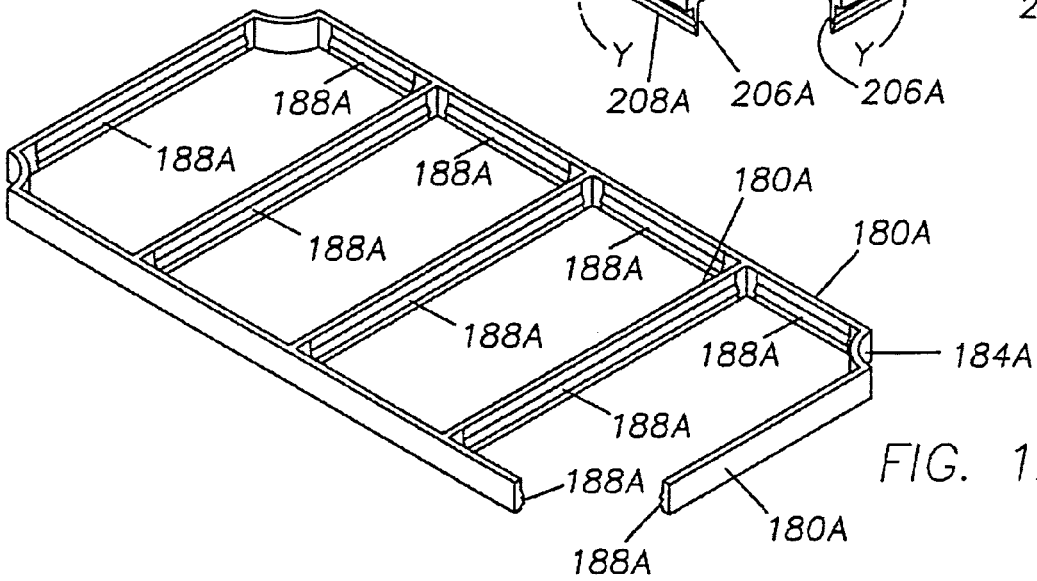
FIG. 12B is a perspective view of another support frame according to a preferred embodiment of the particulate screening system shown in FIG. 1.

Referring to FIG. 12B, a second preferred embodiment of a reinforcing support frame 18A is similar to the frame 18 described with respect to FIG. 11B. The reinforcing support frame 18A has a perimeter member 180A formed in a substantially rectangular shape with bracing members 182A extending laterally between longitudinal sides of the perimeter member 180A. The frame 18A also includes four arcuate-shaped corners 184A. The frame 18A of this embodiment, however, is provided with gripping surfaces 188A. The gripping surfaces are located along engagement surfaces of its members. The engagement surfaces include the inwardly facing surfaces of the perimeter member 180A, except at arcuate-shaped corners 184A thereof, and both side surfaces of each of the bracing members 182A.

Figure 12C:
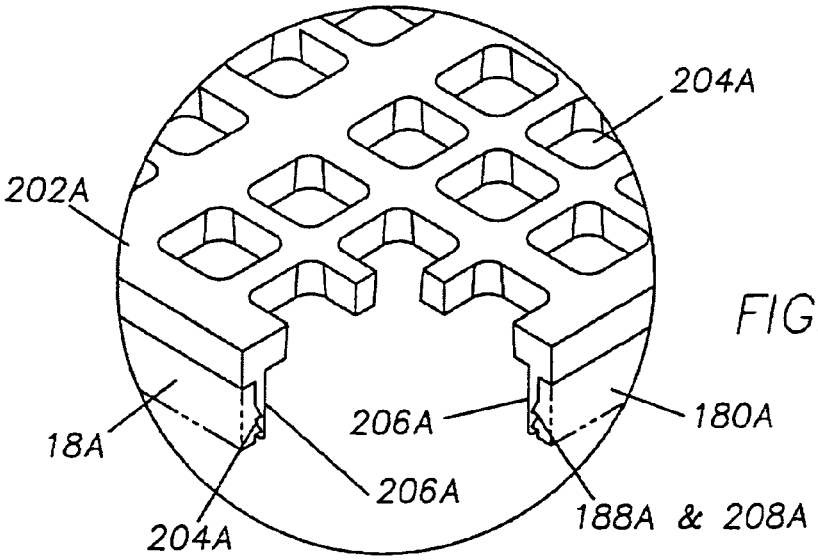
FIG. 12C is a sectional view taken along arcuate-shaped line Y—Y of FIG. 12A.

Now referring to FIG. 12C, when the screening module 20A is placed over and mated with the reinforcing support frame 18A, their gripping surfaces 208A and 188A communicate in a frictional relationship to provide a secure, yet easily removable, attachment between them.

Of course, the two attachment methods described with reference to these preferred embodiments are but two of the many possible embodiments of the present invention. It should be appreciated by those skilled in the art that any method of engagement between the frame engagement members of the screening modules and the engagement surfaces of the support frame is contemplated, so long as it provides for ready, secure attachment and easy separation of the module and frame. Other potential embodiments, for instance, can comprise a tab and recess snap fit, an interference fit, or a toothed engagement. Other means and methods of securing a readily detachable locking engagement between the screening module and the frame are also within the contemplation of this invention.

Figure 13A:
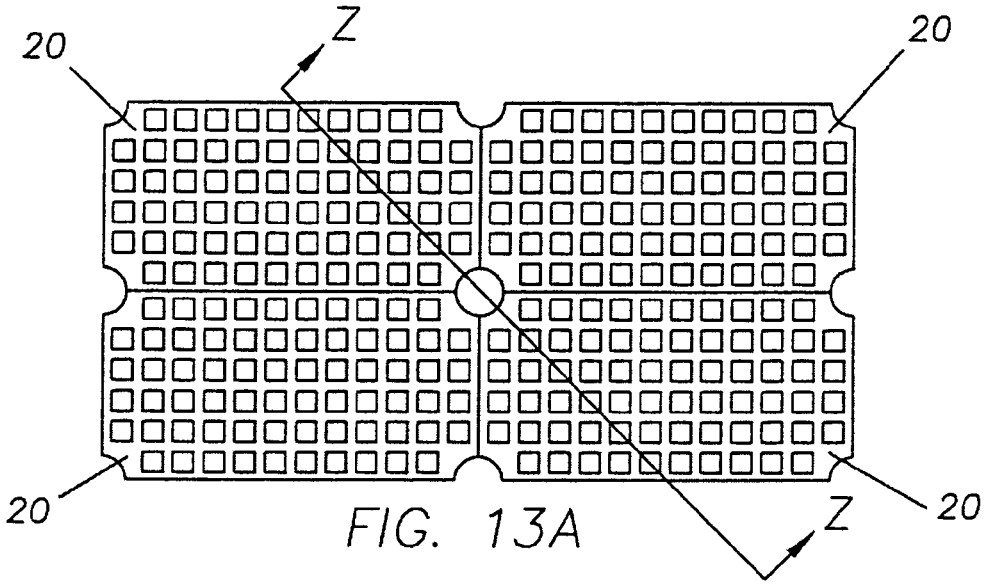
FIG. 13A is a plan view of a portion of the screening system of FIG. 1, having components as shown in FIGS. 11A, 11B, and 11C, according to a preferred embodiment of the invention.
Figure 13B:
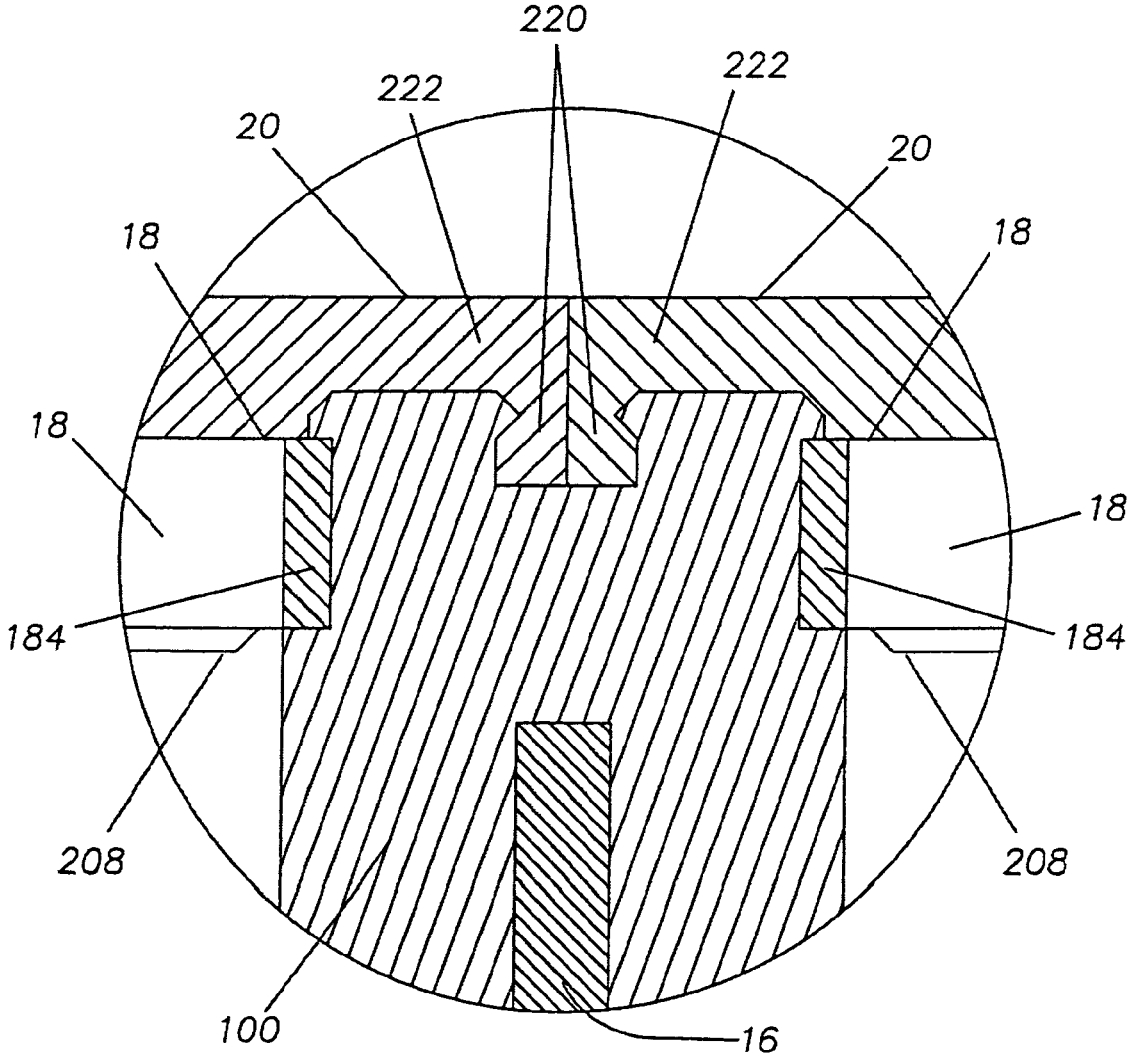
FIG. 13B is a cross-sectional view of taken along line Z—Z of FIG. 13A, showing engagement between an interlocking post, a reinforcing support frame, and a screening module in accordance with a preferred embodiment of the present invention.

FIG. 13A is a plan view of a portion of deck assembly as shown in FIG. 1. The deck assembly includes a screening system with screening modules and reinforcing support frames mounted on interlocking posts. FIG. 13B is a cross-sectional view of the deck assembly of FIG. 13A, taken along line Z—Z, enlarged to show the engagement between a full post 100, a reinforcing support frame 18, and a screening module 20, in accordance with a first preferred embodiment of the present invention. Referring to FIG. 13B, the arcuate-shaped slot of a full post 100 lockingly, yet removably, engages an arcuate-shaped corner of reinforcing support frames 18. The post 100 also lockingly, yet removably, engages with tabs 220 and receptacles 222 of post engagement members, located at the corners of the screening modules 20. Locking tabs 208 of the frame engagement members 206 of the screening modules 20 lockingly engage members of the frame 18. In this manner, the screening module 20 is lockingly, yet removably, attached to the reinforcing support frame 18 and the post 100. The post 100 is secured to support bar 16. In this manner, a secure yet removable connection is provided between a screening module, a reinforcing support frame, and posts attached to the deck assembly.

Figure 14A:
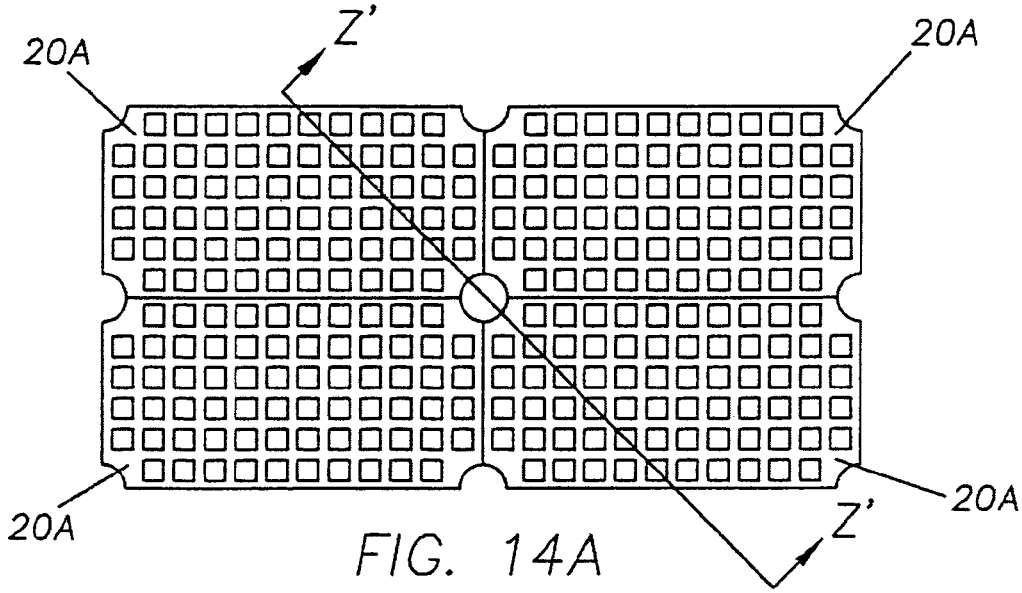
FIG. 14A is a portion of a plan view of the screening system of FIG. 1, having components as shown in FIGS. 12A, 12B, and 12C.
Figure 14B:
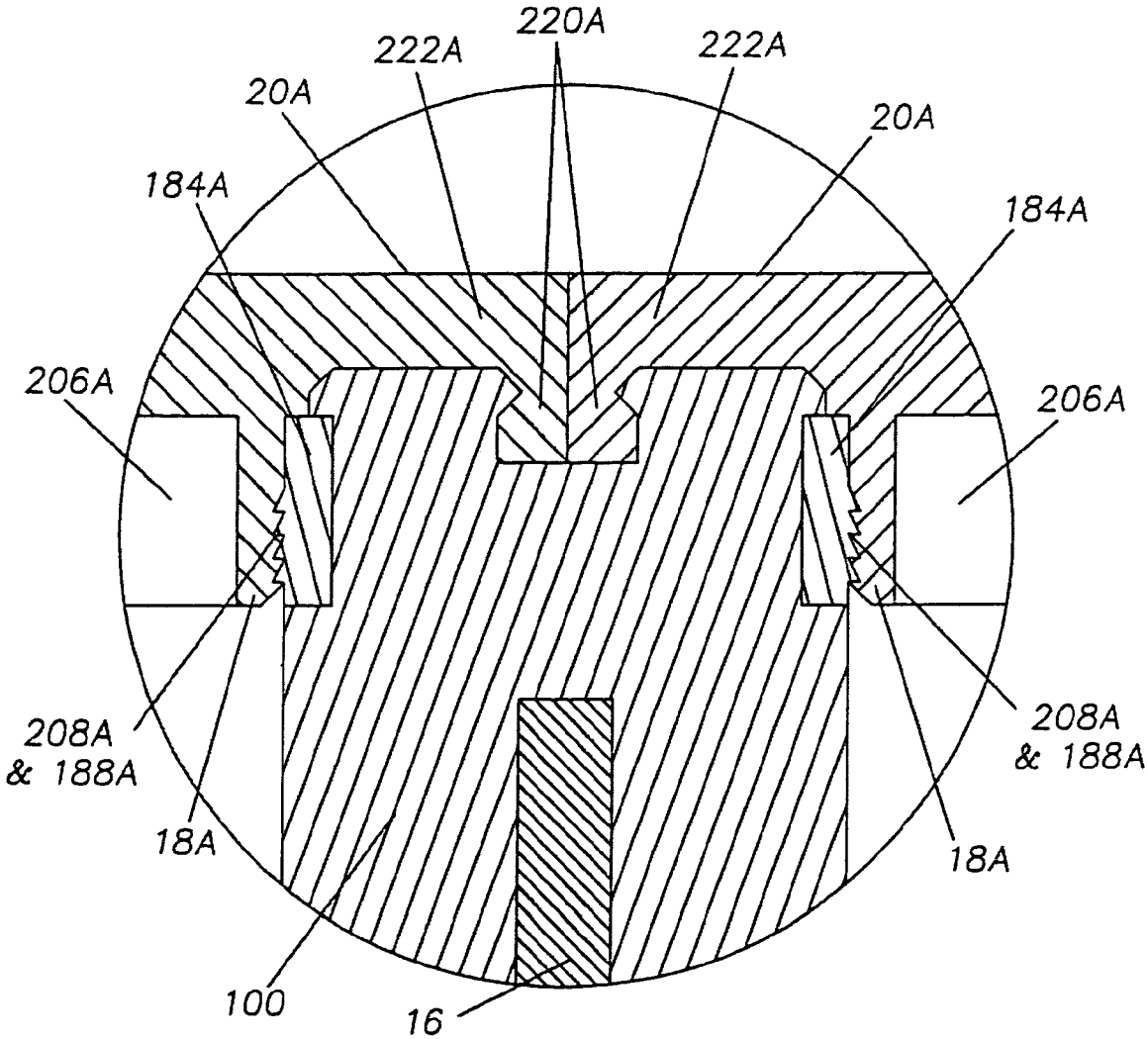
FIG. 14B is a cross-sectional taken along line Z'—Z', showing engagement between an interlocking post, a reinforcing support frame, and a screening module according to a preferred embodiment of the present invention.

FIG. 14A is a plan view of a portion of the deck assembly of FIG. 1 having a screening system with screening modules, reinforcing support frames, and interlocking posts. FIG. 14B is a cross-sectional view of FIG. 14A, taken along line Z'—Z', enlarged to show the engagement between a full post 100, a reinforcing support frame 18A, and a screening module 20A in accordance with yet another preferred embodiment of the present invention. Referring to FIG. 1B, the arcuate-shaped slot of the post 100 lockingly engages an arcuate-shaped corner of the frame 18A. The post 100 also lockingly engages with tabs 220A and receptacles 222A of post engagement members located on the corners of the screening modules 20A. Gripping surfaces 188A and 208A of the reinforcing support frames 18A and of the screening module's frame engagement members 206A, respectively, mate to provide a secure yet removable connection between the frame and the screening module.

Having illustrated and described the principles of my invention in a preferred embodiment thereof, it should be readily apparent to those skilled in the art that the invention can be modified in arrangement and detail without departing from such principals. I claim all modifications coming within the spirit and scope of the accompanying claims.

The invention claimed is:

1. A module for screening or diverting particulate material comprising either one of a screening member having a unitary, single-level structure including an array of sieve apertures of a predetermined size defined therein for allowing particulate material up to the predetermined size to pass through the module or a diverting member having a unitary, single-level structure for redirecting the flow path of the said particulate material, the screening and diverting member including a frame engagement member, extending downwardly from a lower surface of the screening or diverting member, for interlockingly mounting the screening or diverting member onto a reinforcing support frame such that the screening or diverting member is readily attachable to and detachable therefrom, and such that particulate material passing through the screening member passes through the reinforcing support frame, the screening or diverting member comprising a substantially rectangular shape having a plurality of corners and being further interlockingly mountable onto a plurality of posts such that the screening or diverting member is readily detachable therefrom, wherein each said post is substantially connected to a single corner of the screening or diverting member, wherein said posts are spaced from said frame engagement member.

2. A module according to claim 1, wherein said screening or diverting member and said frame are configured to mate with a portion of each of said posts by snap-fit engagement.

3. A module according to claim 1, wherein said posts have a substantially circular cross-sectional configuration.

4. A module according to claim 1, wherein at least a portion of a surface of said screening or diverting member includes a gripping surface for engaging a complementary gripping surface on an engagement surface of said frame, thereby providing increased frictional mating engagement between said screening or diverting member and said frame.

5. A module according to claim 1, wherein each of said posts is joined to a mounting piece.

6. A module according to claim 5, wherein said mounting piece comprises a structural bar, a rod, or a tube.

7. A module according to claim 1, wherein each said frame engagement member comprises at least one detent member.

8. A module according to claim 1, wherein the portion of the screening member defining the array of sieve apertures, or the portion of the diverting member redirecting the flow path of the said particulate material, is formed of at least one polymeric material.

9. A module according to claim 7, wherein each detent member includes a locking tab.

10. A module according to claim 1, which is placed over the reinforcing support frame so that the frame engagement member extends along inwardly facing surfaces of the reinforcing support frame.

11. A module according to claim 9, wherein each locking tab engages the reinforcing support frame.

12. A module according to claim 1, which includes a substantially rectangular upper screening member.

13. A module according to claim 1, wherein said frame engagement members comprise substantially planar extensions having inwarding and outwarding facing sides.

14. A module according to claim 7, wherein said detent member includes a gripping surface for engaging a complementary gripping surface on an engagement surface of said frame.

15. A module according to claim 1, wherein said screening or diverting member defines a plurality of receptacles, each receptacle receiving and retaining a portion of each of said posts.

16. A module according to claim 1, wherein said screening or diverting member includes a frame engagement member extending from a lower surface thereof for readily and interlockably mounting said module onto at least one said frame.

17. A module according to claim 14, wherein said gripping surface on said detent member is located along its outwardly facing side.

18. A method for producing a module for screening or diverting particulate material, comprising:

forming a module comprising either one of a screening member having a unitary, single-level structure including an array of sieve apertures of a predetermined size defined therein for allowing particulate material up to the predetermined size to pass through the module and a diverting member a unitary, single-level structure including for redirecting the flow path of the said particulate material, the screening and diverting member comprising a substantially rectangular shape having a plurality of corners and including a frame engagement member, extending downwardly from a lower surface of the screening or diverting member, for interlockingly mounting the screening or diverting member onto a reinforcing support frame such that the screening or diverting member is readily attachable to and detachable therefrom; and configuring said screening or diverting module for interlockingly and detachably mountability onto a reinforcing support frame and substantially connecting a single corner onto each of a plurality of pasts which removably and interlockingly support a reinforcing support frame, said module being disposable over at least a portion of at least one of the posts, wherein said posts are spaced from said frame engagement member, the module being positionable on the reinforcing support frame so that particulate material passing through the screening module passes through the reinforcing support frame.

19. A method according to claim 18, wherein said screening or diverting member and said frame are configured to mate with a portion of each of said posts by snap-fit engagement.

20. A method according to claim 18, wherein each of said posts have a substantially circular cross-sectional configuration.

21. A method according to claim 18, wherein at least a portion of a surface of said screening or diverting member includes a gripping surface for engaging a complementary gripping surface an an engagement surface of said frame, thereby providing increased frictional mating engagement between said screening or diverting member and said frame.

22. A method according to claim 18, wherein each of said posts is joined to a mounting piece.

23. A method according to claim 22, wherein each said mounting piece comprises a structural bar, a rod, or a tube.

24. A method according to claim 18, where each said frame engagement member comprises at least one detent member.

25. A method according to claim 18, wherein the portion of the screening member defining the array of sieve apertures, or the portion of the diverting member redirecting the flow path of the said particulate material, is formed of at least one polymeric material.

26. A method according to claim 24, wherein each detent member includes a locking tab.

27. A method according to claim 18, in which the module is placed over the reinforcing support frame so that the frame engagement member extends along inwardly facing surfaces of the reinforcing support frame.

28. A method according to claim 27, wherein each locking tab engages the reinforcing support frame.

29. A method according to claim 18, which includes a substantially rectangular upper screening member.

30. A method according to claim 18, wherein said frame engagement members comprise substantially planar extensions having inwarding and outwarding facing sides.

31. A method according to claim 24, wherein said detent member includes a gripping surface for engaging a complementary gripping surface on an engagement surface of said frame.

32. A method according to claim 18, wherein said screening or diverting member defines a plurality of receptacles, each receptacle receiving and retaining a portion of each of said posts.

33. A method according to claim 18, wherein said screening or diverting member includes a frame engagement member extending from a lower surface thereof for readily and interlockably mounting said module onto at least one said frame.

34. A method according to claim 31, wherein said gripping surface on said detent member is located along its outwardly facing side.

35. A module for screening or diverting particulate material comprising either one of a screening member having a unitary, single-level structure including an array of sieve apertures of a predetermined size defined therein for allowing particulate material up to the predetermined size to pass through the module or a diverting member having a unitary, single-level structure for redirecting the flow path of the said particulate material, the screening and diverting member including a frame engagement member extending downwardly from a lower surface of the screening or diverting member, for interlockingly mounting the screening or diverting member onto a reinforcing support frame such that the screening or diverting member is readily attachable to and detachable therefrom, and such that particulate material passing through the screening member passes through the reinforcing support frame, the frame engagement member comprising a detent extending downwardly from a lower surface of the screening or diverting member for readily and interlockingly mounting the screening or diverting member onto said frame, the screening or diverting member being further interlockingly mountable onto a plurality of posts such that the screening or diverting member is readily detachable therefrom, wherein the screening or diverting member comprises a substantially rectangular shape having a plurality of corners, wherein each said post is substantially connected to a single corner of the screening or diverting member, wherein said posts are spaced from said frame engagement member.

36. A module according to claim 35, having a substantially circular cross-sectional configuration.

* * * * *